US009986797B2

(12) United States Patent
Sato et al.

(10) Patent No.: US 9,986,797 B2
(45) Date of Patent: Jun. 5, 2018

(54) WALKING STICK AND WALKING ASSISTANCE DEVICE

(71) Applicant: Panasonic Intellectual Property Management Co., Ltd., Osaka (JP)

(72) Inventors: Yoshikuni Sato, Fukui (JP); Toru Nakada, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/206,424

(22) Filed: Jul. 11, 2016

(65) Prior Publication Data

US 2017/0055650 A1 Mar. 2, 2017

(30) Foreign Application Priority Data

Aug. 31, 2015 (JP) ..... 2015-171576
Mar. 4, 2016 (JP) ..... 2016-042542

(51) Int. Cl.

| | |
|---|---|
| ***A45B 3/02*** | (2006.01) |
| ***A45B 3/04*** | (2006.01) |
| ***A45B 3/08*** | (2006.01) |
| ***A45B 9/02*** | (2006.01) |
| ***A45B 9/04*** | (2006.01) |
| ***F21V 14/02*** | (2006.01) |
| ***F21V 23/04*** | (2006.01) |
| *F21Y 115/30* | (2016.01) |
| *F21Y 115/10* | (2016.01) |

(52) U.S. Cl.

CPC ..... *A45B 3/04* (2013.01); *A45B 3/08* (2013.01); *A45B 9/02* (2013.01); *A45B 9/04* (2013.01); *F21V 14/02* (2013.01); *F21V 23/0492* (2013.01); *F21Y 2115/10* (2016.08); *F21Y 2115/30* (2016.08)

(58) Field of Classification Search

CPC .... A45B 3/04; A45B 3/08; A45B 9/02; A45B 9/04; F21V 14/02; F21V 23/0492

USPC ..... 362/102

See application file for complete search history.

(56) References Cited

U.S. PATENT DOCUMENTS 9,675,515 B2 * 6/2017 Chou ..... A61H 3/00
2016/0309861 A1 * 10/2016 Chou ..... A45B 3/04

FOREIGN PATENT DOCUMENTS

JP 2003-102526 4/2003
JP 2016-159133 9/2016

OTHER PUBLICATIONS

Ling Bao et al., "Activity Recognition from User-Annotated Acceleration Data", Pervasive Computing, pp. 1-17, 2004.

(Continued)

*Primary Examiner* — Paultep Savusdiphol

(74) *Attorney, Agent, or Firm* — Wenderoth, Lind & Ponack, L.L.P.

(57) ABSTRACT

A walking stick includes a main part that is stick-like, a sensor that detects at least one of an acceleration of the main part and an angular velocity of the main part, a light emitter that emits light on a ground, a balance evaluator that evaluates a user's walking balance stability based on at least one of the detected acceleration and the detected angular velocity, and an emitting controller that controls a light emitting direction of the light based on a result of the evaluation and an inclination angle of the main part.

17 Claims, 14 Drawing Sheets

(56) References Cited

OTHER PUBLICATIONS

M. Yamada et al., "The Assessment of an Abnormal Gait by Gait Parameters derived from Trunk Acceleration in Patients with Osteoarthritis of the Hip", Journal of the Japanese Physical Therapy Association, vol. 33(1), pp. 14-21, 2006.
Extended European Search Report dated Jan. 24, 2017 in corresponding European Application No. 16178976.3.

* cited by examiner

FIG. 13

| WALKING CONDITION | STANDARD LIGHT EMITTING ANGLE |
|---|---|
| LEVEL GROUND | 30° |
| ASCENDING STAIRS | 20° |
| DESCENDING STAIRS | 15° |
| ... | ... |

WALKING STICK AND WALKING ASSISTANCE DEVICE

BACKGROUND

1. Technical Field

The present disclosure relates to a walking stick and a walking assistance device that aid stable walking.

2. Description of the Related Art

Along with the recent aging of the population, the prevention of falling due to reduced walking function is becoming an important issue. Means of compensating for reduced walking function include devices such as handrails, walking sticks (hereinafter also simply called sticks), wheelchairs, and walking aids that provide mechanical support, depending on the degree of support and intended purpose.

The stick is the most common walking aid used by users who are able to walk independently but are still at risk of falling. A stick has an advantageous effect of providing balance while walking to keep the user from falling.

Japanese Unexamined Patent Application Publication No. 2003-102526 is an example of technology of the related art that uses a stick to provide walking assistance. Japanese Unexamined Patent Application Publication No. 2003-102526 discloses a stick with a built-in light. When a user walks down a road at night holding the stick according to Japanese Unexamined Patent Application Publication No. 2003-102526, the light built into the stick illuminates the way and the ground at the user's feet, thereby enabling the user to walk with the stick without needing to hold a flashlight separate from the stick.

SUMMARY

However, the above technology of the related art is limited to providing assistance by way of illumination when walking at night, and does not consider whether balance assistance is being provided suitably to the user while walking.

One non-limiting and exemplary embodiment provides a walking stick capable of effectively stabilizing the user's walking balance.

In one general aspect, the techniques disclosed here feature a walking stick including a main part that is stick-like, a sensor that detects at least one of an acceleration of the main part and an angular velocity of the main part, a light emitter that emits light on a ground, and a controller that includes a balance evaluator and an emitting controller, the balance evaluator evaluating a user's walking balance stability based on at least one of the detected acceleration and the detected angular velocity, and the emitting controller controlling a light emitting direction of the light based on a result of the evaluation and an inclination angle of the main part.

A walking stick according to one general aspect is capable of effectively assisting a user's walking.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 13 is a diagram illustrating an example of multiple standard light emitting angles stored in light emitting angle storage according to Embodiment 5;

DETAILED DESCRIPTION (Overview of Disclosure)

Figure 1:
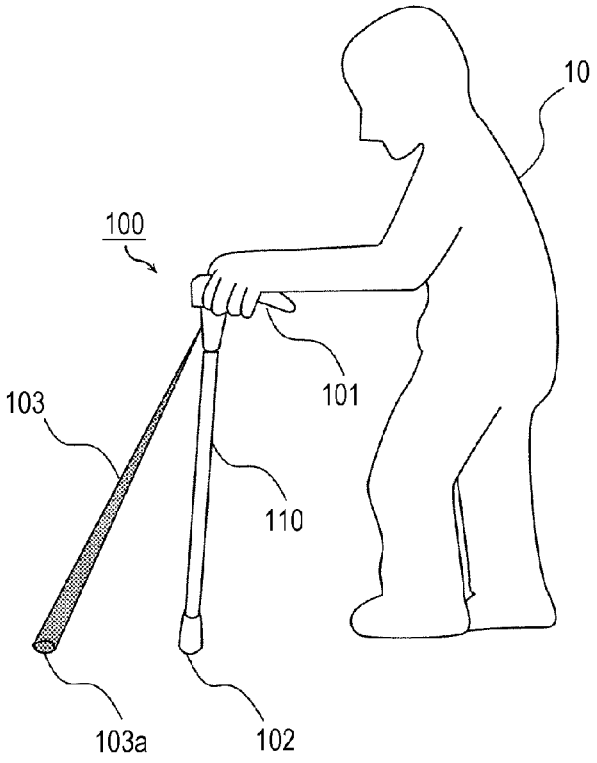
FIG. 1 is a diagram illustrating a usage scenario of a walking stick according to Embodiment 1.

The inventor discovered that the following problem occurs with regard to walking using a stick.

When walking using a stick, the position where the tip of the stick thrusts greatly affects walking balance. If the user is unable to thrust the stick at a position where walking balance is stable, the user may lose his or her balance and fall. However, in some cases, the user does not know the position in which to thrust the stick for stable walking balance.

Accordingly, a walking stick according to one aspect of the present disclosure includes a main part that is stick-like, a sensor that detects at least one of an acceleration of the main part and an angular velocity of the main part, a light emitter that emits light on a ground, and a controller that includes a balance evaluator and an emitting controller, the balance evaluator evaluating a user's walking balance stability based on at least one of the detected acceleration and the detected angular velocity, and the emitting controller controlling a light emitting direction of the light based on a result of the evaluation and an inclination angle of the main part.

According to this configuration, the light emitting direction of the light from the light emitter may be controlled based on the detected inclination angle. Consequently, when light is emitted on the ground to indicate the next position at which to thrust the tip of the main part of the stick, the light emitting position may be stabilized. As a result, the walking stick is capable of stabilizing the indication of the next position at which to thrust the tip of the main part of the stick, and is capable of effectively assisting the user's walking balance.

Furthermore, according to this configuration, the light emitting direction may be controlled based on the result of the evaluation of the walking balance stability while walking. Consequently, when walking balance is lost while walking, the light emitting direction may be controlled effectively to stabilize walking balance, and falling by the user may be minimized.

For example, the emitting controller may continue to emit light from the light emitter at a certain light emitting position on the ground for a certain amount of time, even if the inclination angle of the main part changes.

According to this configuration, it is possible to continue to emit light from the light emitter at a certain light emitting position on the ground for a certain amount of time, even if the inclination angle of the main part changes. Consequently, the light emitting position of the light may be stabilized for a certain amount of time, and the user's walking balance may be assisted effectively.

For example, the walking stick additionally may include a ground contact sensor that detects contact with the ground at the tip of the main part, and the certain amount of time may be a time from when the ground contact sensor detects ground contact of the tip until the ground contact sensor detects the next ground contact.

According to this configuration, it is possible to continue to emit light from the light emitter at a certain light emitting position on the ground from when the ground contact sensor detects ground contact of the tip of the main part until the ground contact sensor detects the next ground contact. Consequently, the light emitting position of light may be stabilized in accordance with the cycle of thrusting the stick.

For example, the emitting controller may control the light emitting direction using the inclination angle of the main part and a standard light emitting angle indicating a predetermined light emitting direction with respect to a predetermined inclination angle, and adjust the standard light emitting angle based on the result of the evaluation of stability. Specifically, for example, provided that $\alpha$ represents the standard light emitting angle when the standard inclination angle is 0 degrees with respect to a vertical direction, and $\beta$ represents the inclination angle between a lengthwise direction of the main part of the stick and the vertical direction, the emitting controller may use $\alpha$ and $\beta$ to derive a light emitting angle $\gamma$ between the lengthwise direction of the main part of the stick and the optical axis of light from the light emitter according to the following Math. 1, and use the derived light emitting angle $\gamma$ to control the light emitting direction.

$$\gamma = \cos^{-1}\frac{1 - \tan\alpha\sin\beta}{\sqrt{1 + \tan^2\alpha - 2\tan\alpha\sin\beta}} \quad \text{(Math. 1)}$$

According to this configuration, the light emitting direction may be controlled using the detected inclination angle and the standard light emitting angle. Consequently, if the standard light emitting angle is determined appropriately according to characteristics such as the user and the walking stick, for example, the light emitting direction of light may be controlled appropriately according to characteristics such as the user and the walking stick, and the user's walking balance may be assisted effectively.

For example, the emitting controller may decrease the standard light emitting angle if an evaluation score expressing the lowness of walking balance stability obtained as a result of the evaluation is greater than a certain threshold value.

According to this configuration, by decreasing the standard light emitting angle if the evaluation score is greater than the threshold value, the light emitting position may be brought closer to the walking user. Consequently, when the stability of walking balance is reduced, the user may be guided to thrust the tip of the main part of the stick at a closer position, thereby improving the user's walking balance, and minimizing falling.

For example, the emitting controller may cause the light emitter to start emitting light if the evaluation score is greater than the certain threshold value.

According to this configuration, light emission may be started if the evaluation score is greater than the threshold value. Consequently, since light emission is not started when walking balance is stable, the user is able to walk without paying attention to the light emitting position, and walk freely without being limited by the light emitting position of the light. Also, when the stability of walking balance is reduced, the user may be made to notice the reduction in walking balance, and falling by the user 10 may be minimized. On the other hand, since light emission is started when the stability of walking balance is reduced, the light may be used to explicitly inform the user that walking balance is reduced, and the user may be encouraged to improve walking balance.

For example, the evaluation score may be at least one of a timewise variance of the detected acceleration and a timewise variance of the detected angular velocity.

According to this configuration, the timewise variance of the acceleration or the angular velocity may be used as the evaluation score, and the stability of walking balance may be evaluated easily.

For example, the balance evaluator may additionally detect a fall of the user, and compute an evaluation score of the walking balance stability during a certain period immediately prior to the fall being detected. The computed evaluation score may be used as the certain threshold value.

According to this configuration, the evaluation score of walking balance stability during a certain period immediately prior to a fall being detected may be used as the certain threshold value. Consequently, the evaluation score of walking balance stability when the user actually falls may be used to control the light emitting direction, and falling by the user may be minimized further.

For example, the controller may additionally include storage for storing multiple standard light emitting angle candidates. The balance evaluator may evaluate walking balance stability when light is emitted in accordance with the predetermined multiple standard light emitting angle candidates, and based on the result of the evaluation, store one of the multiple standard light emitting angle candidates as the standard light emitting angle in the storage. The emitting controller may acquire the standard light emitting angle from the storage, and use the acquired standard light emitting angle to control the light emitting direction.

According to this configuration, the standard light emitting angle may be stored in storage based on the result of the evaluation of walking balance stability when walking using the walking stick. Consequently, a standard light emitting angle suited to the characteristics of the walking stick and the user may be determined in advance. By using a standard light emitting angle determined in this way to control the light emitting direction, control of the light emitting direction that is suited to the characteristics of the user and the walking stick becomes possible, and more effective assistance of the user's walking balance becomes possible.

For example, the storage may store multiple standard light emitting angles corresponding to multiple walking conditions. The balance evaluation may use at least one of the detected acceleration and the detected angular velocity to estimate the walking condition of the user currently walking with the walking stick. The emitting controller may acquire, from the storage, the standard light emitting angle corresponding to the estimated walking condition, and use the acquired standard light emitting angle to control the light emitting direction.

According to this configuration, a standard light emitting angle corresponding to an estimated walking condition may be used to control the light emitting direction. Consequently, a standard light emitting angle that is suited to situations such as walking on level ground or walking up or down stairs, for example, may be used to control the light emitting direction, and the user's walking balance may be assisted more effectively.

For example, the emitting controller may also cause the light emitter to emit light when the tip of the main part is contacting the ground.

According to this configuration, the light emitter may be made to emit light when the tip of the main part is contacting the ground, and thus light may be emitted when starting the next operation for thrusting the stick, and the user may be guided appropriately to the next position at which to thrust the tip of the main part.

For example, the sensor may additionally detect the inclination angle of the main part. As another example, the walking stick may additionally include an inclination angle calculator that calculates the inclination angle of the main part, based on at least one of the acceleration and the angular velocity detected by the sensor.

According to these configurations, the freedom of design with regard to the sensor may be increased.

A walking assistance device according to one aspect of the present disclosure is a walking assistance device attached to a walking stick, and includes a sensor that detects at least one of an acceleration of the walking stick and an angular velocity of the walking stick, a light emitter that emits light on a ground, a balance evaluator that evaluates a user's walking balance stability based on at least one of the detected acceleration and the detected angular velocity, and an emitting controller that controls a light emitting angle of the light from the light emitter based on a result of the evaluation and an inclination angle of the walking stick.

According to this configuration, the walking assistance device is able to realize advantageous effects similar to the above walking stick.

Hereinafter, exemplary embodiments will be described with reference to the drawings.

Note that the exemplary embodiments described hereinafter all illustrate general or specific examples. Features such as numerical values, shapes, materials, structural elements, layout positions and connection states of structural elements, steps, and the ordering of steps indicated in the following exemplary embodiments are merely examples, and are not intended to limit the claims. In addition, among the structural elements in the following exemplary embodiments, structural elements that are not described in the independent claim indicating the broadest concept are described as arbitrary or optional structural elements.

Also, the drawings are diagrammatic views, and are not necessarily drawn strictly. Note that in the drawings, structural elements that are substantially the same are denoted with the same signs, and duplicate description of such structural elements will be reduced or omitted.

Embodiment 1

[Usage Scenario of Walking Stick]

FIG. 1 illustrates a usage scenario of a walking stick according to Embodiment 1. As illustrated in FIG. 1, a user 10 grips a handle 101 of a walking stick 100 and walks while maintaining balance by thrusting the tip 102 of the main part 110 of the walking stick towards the ground. At this point, the walking stick 100 emits light 103 onto the ground, the light 103 indicating the next position at which the user 10 is to thrust the tip 102. The user 10 is able to maintain balance suitably while walking by subsequently thrusting the tip 102 of the walking stick 100 at a light emitting position 103*a* on the ground illuminated by the light 103.

Note that the ground herein means the surface that the user 10 is walking on, and is not limited to being the surface of land (earth's surface). The ground may also be a floor inside a building.

[Configuration of Walking Stick]

A configuration of such a walking stick 100 will be described specifically with reference to FIGS. 2 to 4.

Figure 2:
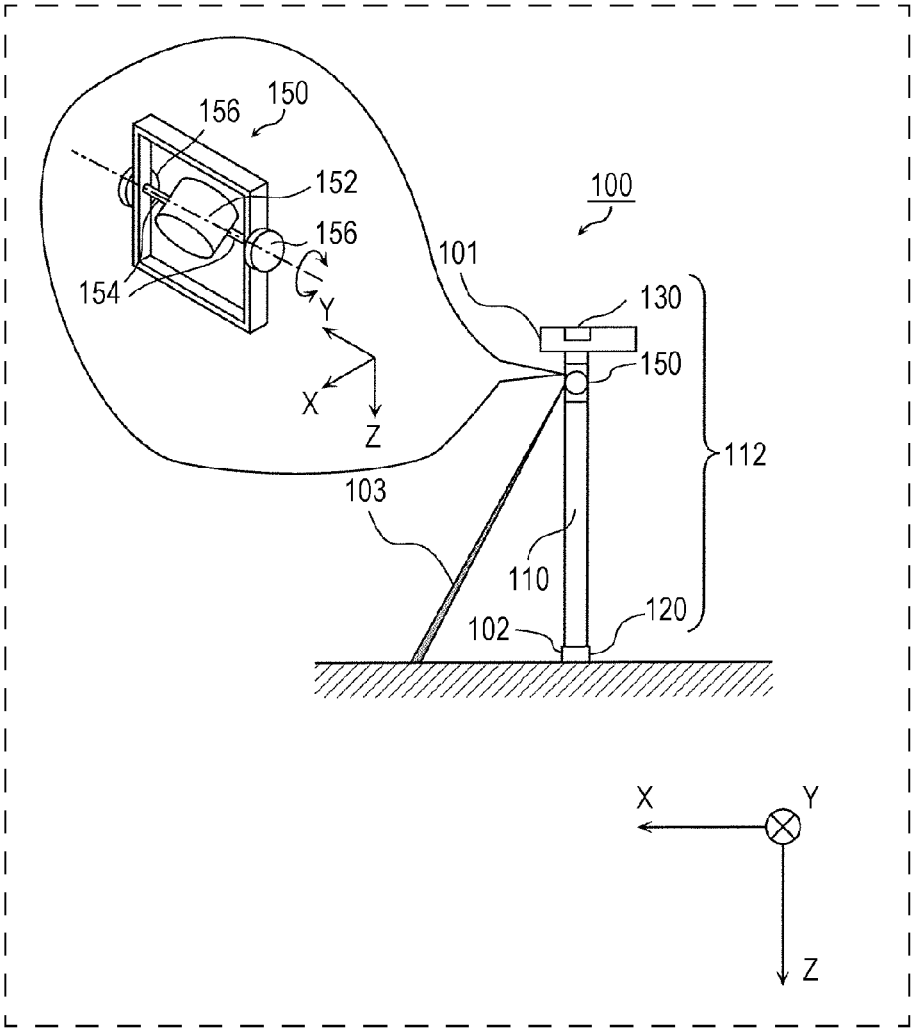
FIG. 2 is a diagram illustrating a structure of a walking stick according to Embodiment 1.

FIG. 2 illustrates a structure of a walking stick according to Embodiment 1. FIG. 3 is a block diagram illustrating a detailed functional configuration of a walking stick according to Embodiment 1. FIG. 4 is a diagram for explaining a light emitting angle and an inclination angle according to Embodiment 1.

In each drawing, the X-axis direction is the horizontal direction of the T-shape of the handle 101. The Z-axis direction is the lengthwise direction of the main part 110. The Y-axis direction is the direction orthogonal to the X-axis direction and the Z-axis direction. Note that the X-axis direction is in approximate alignment with the forward direction of the user walking using the walking stick 100. In FIG. 4, the dashed line represents the walking stick 100 at a standard inclination angle (0 degrees), while the chain lines represent the optical axis.

The walking stick 100 includes a main part 110 and a handle 101. The walking stick 100 also includes a walking assistance device 112.

The main part 110 is a long stick or rod. The handle 101 is provided on one end of the main part 110, while a ground contact detector 120 is provided on the other end.

The handle 101 is the part gripped by the user 10, and has a shape such as a T-shape or an L-shape.

The walking assistance device 112 is attached to the walking stick 100 to assist walking by the user 10. The walking assistance device 112 may also be removably attachable to the walking stick 100. The walking assistance device 112 includes a ground contact detector 120, a sensor 130, a controller 140, and a light emitter 150.

The ground contact detector 120 is an example of a ground contact sensor that detects contact with the ground at the tip of the main part 110 (hereinafter also called ground contact). In the present embodiment, the ground contact detector 120 detects ground contact of the main part 110 by using a pressure sensor. Specifically, the ground contact detector 120 detects ground contact of the main part 110 when the pressure value from the pressure sensor becomes equal to or greater than a certain threshold value. Provided that the surface area of the tip of the stick is 10 $cm^2$ and the weight of the stick is 0.5 kg, the value used as the certain threshold value may be, for example, the value of approximately double the pressure when the stick is simply placed against the ground (0.1 $kg/cm^2$).

The sensor 130 detects the inclination angle of the main part 110. In addition, the sensor 130 detects the motion of the main part 110 (for example, at least one of the acceleration and the angular velocity). Specifically, the sensor 130 includes (i) an inclination angle sensor, and (ii) an acceleration sensor or an angular velocity sensor, which provided inside the handle 101, for example. The inclination angle refers to the inclination of the main part 110 with respect to the vertical direction or the horizontal direction.

The controller 140 controls the light emitting direction of light from the light emitter 150, based on the inclination angle detected by the sensor 130. Specifically, the controller 140 controls the light emitting direction so that a light emitting position on the ground of light from the light emitter 150 does not change, even if the inclination angle of the main part 110 changes. Specifically, the controller 140 continues to emit light from the light emitter 150 at a certain light emitting position on the ground for a certain amount of time, even if the inclination angle of the main part 110 changes. The certain amount of time is, for example, the time from when ground contact at the tip 102 of the main part 110 is detected until the next ground contact is detected. In other words, during the period from when the tip 102 of the main part 110 makes ground contact until the next time the tip 102 of the main part 110 makes ground contact, the controller 140 controls the light emitting direction so that the distance from the tip 102 to the light emitting position 103*a* is maintained at a fixed distance (for example, at some distance from 50 cm to 100 cm).

The controller 140 may be any component equipped with control functions, and may be realized in any way. For example, the controller 140 may be configured as dedicated hardware. As another example, the controller 140 may also be realized by executing a software program suited to each structural element. In this case, the controller 140 may include a computational processor (not illustrated) and storage (not illustrated) that stores a control program, for example. Examples of a computational processor include a micro-processing unit (MPU) and a central processing unit (CPU). An example of storage is semiconductor memory. Note that the controller 140 may also be configured as a single controller that performs centralized control, or be configured as multiple controllers that cooperate with each other to perform decentralized control.

Figure 3:
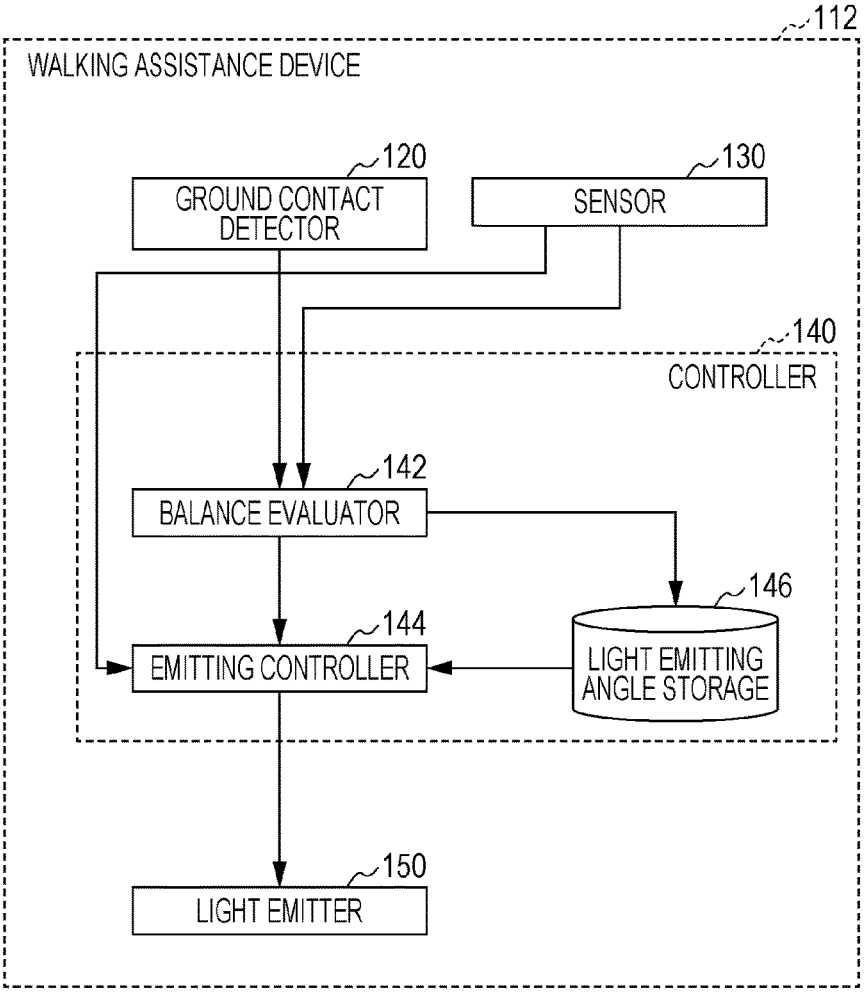
FIG. 3 is a diagram illustrating a detailed functional configuration of a walking stick according to Embodiment 1.

As illustrated in FIG. 3, the controller 140 includes a balance evaluator 142, an emitting controller 144, and light emitting angle storage 146.

When the ground contact detector 120 detects that the tip 102 of the main part 110 is touching the ground, the balance evaluator 142 evaluates the stability of the user's walking balance based on the sensor value obtained by the sensor 130. Specifically, the balance evaluator 142 computes an evaluation score indicating the lowness of walking balance stability. This evaluation score is a timewise variance of the acceleration or the angular velocity obtained from the sensor 130, for example.

The light emitting angle storage 146 stores a standard light emitting angle. The standard light emitting angle is an angle indicating a predetermined light emitting direction with respect to a predetermined standard inclination angle. In other words, the standard light emitting angle is an angle used as a standard of reference indicating a light emitting direction for emitting light at a position appropriate for stabilizing the user's walking balance. The position appropriate for stabilizing the user's walking balance is a position a fixed distance (for example, from 50 cm to 100 cm) away from the tip of the stick in the forward direction, for example.

Figure 4:
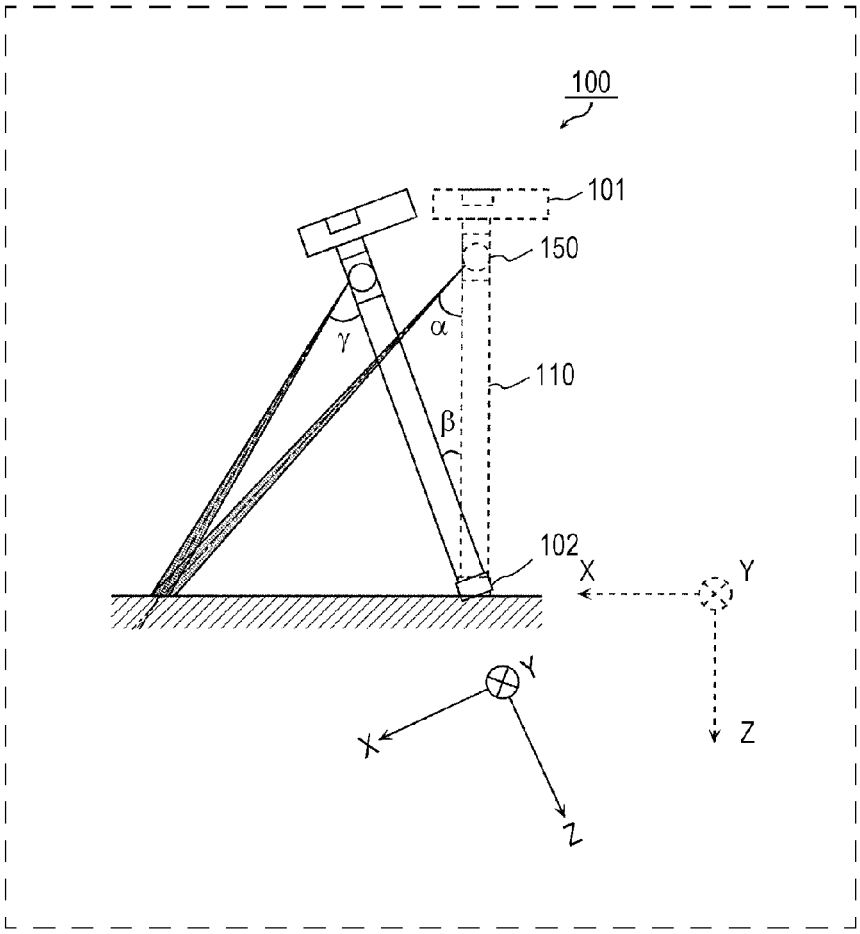
FIG. 4 is a diagram for explaining a light emitting angle and an inclination angle according to Embodiment 1.

In FIG. 4, the standard inclination angle is 0 degrees, and the standard light emitting angle is represented by $\alpha$. Note that the standard inclination angle is not necessarily limited to 0 degrees. The standard light emitting angle may be experientially or experimentally determined in advance according to the characteristics of the walking stick 100 or the light emitter 150. A specific example of a method of deciding the standard light emitting angle will be discussed later in Embodiment 2.

The emitting controller 144 acquires the standard light emitting angle from the light emitting angle storage 146, and uses the standard light emitting angle, as well as the inclination angle of the main part 110 detected by the sensor 130, to control the light emitting direction of the light from the light emitter 150. Specifically, as illustrated in FIG. 4, the emitting controller 144 uses the standard light emitting angle $\alpha$, as well as the inclination angle $\beta$ between the lengthwise direction of the main part 110 (Z-axis direction) and the vertical direction, to derive the light emitting angle $\gamma$ between the lengthwise direction of the main part 110 and the optical axis of the light from the light emitter 150 according to Math. 1 above.

The emitting controller 144 causes the light emitter 150 to emit light at the light emitting angle $\gamma$ derived in this way, and thereby controls the light emitting direction so that the light emitting position on the ground of light from the light emitter 150 does not change, even if the inclination angle of the main part 110 changes.

The light emitter 150 emits light onto the ground to indicate the next position at which the user is to thrust the stick. As illustrated in FIG. 2, the light emitter 150 includes a light source 152, a shaft 154, and an actuator 156.

The light source 152 produces light having directionality. For example, the light source 152 is a laser light source that emits semiconductor laser light as used in devices such as a common laser pointer. Additionally, the light source 152 may also be a light source that condenses and emits light from a light bulb or a light-emitting diode (LED) with a reflective mirror or lens, like a flashlight.

The shaft 154 pivotally supports the light source 152 to enable rotation about the Y-axis. In other words, the light source 152 is supported in a manner enabling the light emitting direction to be changed on a plane (XZ plane) including the axis of the main part 110.

The actuator 156 rotates the light source 152 about the Y-axis, according to instructions from the controller 140. Specifically, the actuator 156 rotates the light source 152 about the Y-axis according to the light emitting angle $\gamma$ specified by the controller 140, and thereby changes the light emitting direction of the light. Specifically, the actuator 156 is an electric motor capable of controlling the rotation angle, for example.

[Operation of Walking Stick]

Figure 5:
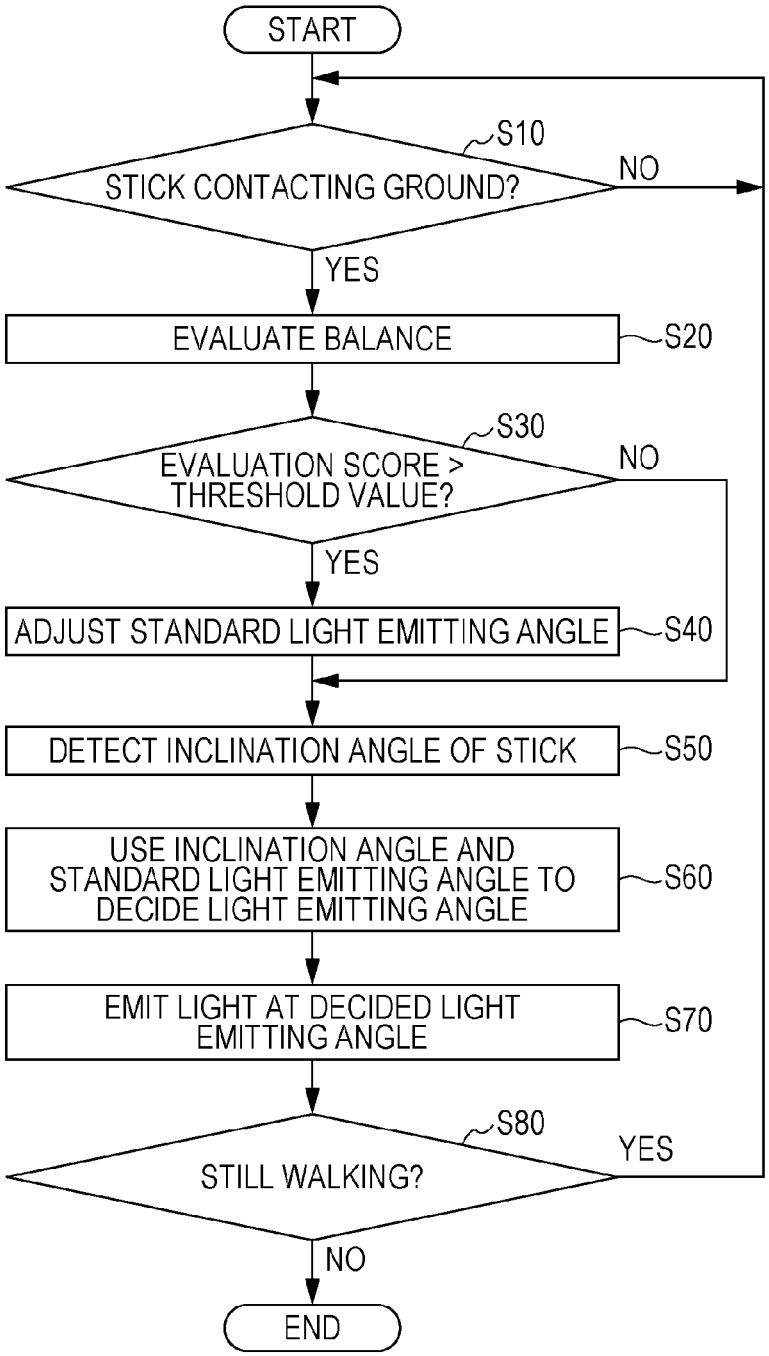
FIG. 5 is a flowchart illustrating a walking aid process of a walking stick according to Embodiment 1.

Next, operation of the walking stick 100 configured as above will be described. FIG. 5 is a flowchart illustrating a walking aid process of a walking stick according to Embodiment 1. First, the ground contact detector 120 detects ground contact of the main part 110 (S10).

At this point, if ground contact of the main part 110 is not detected (S10, No), the process returns to step S10. In other words, step S10 is repeated until ground contact of the main part 110 is detected. Consequently, the walking stick 100 is able to start light emission when ground contact of the main part 110 is detected.

On the other hand, when ground contact of the main part 110 is detected (S10, Yes), the balance evaluator 142 uses sensor values of the user walking acquired from the sensor 130 to evaluate the stability of walking balance (S20). In the present embodiment, the timewise variance of the acceleration or the angular velocity while walking is used as an indicator of walking balance stability. In other words, the balance evaluator 142 computes the variance of the acceleration or the angular velocity as an evaluation score. In the case of using variance as the indicator, a smaller evaluation score means that walking balance is more stable. In other words, in the present embodiment, a larger evaluation score indicates lower stability of walking balance. The evaluation score is thus a value expressing the lowness of walking balance stability.

Figure 6:
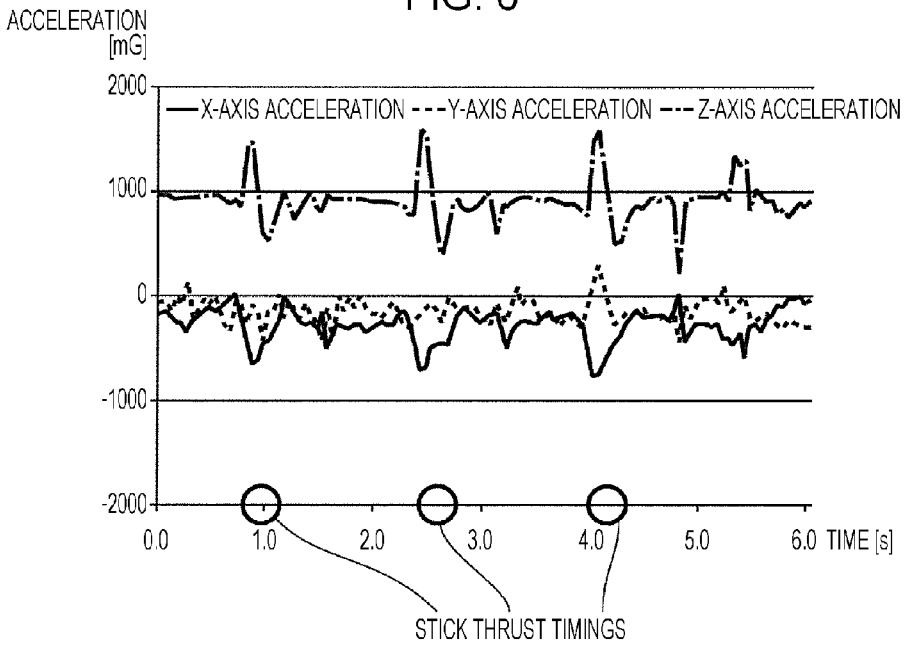
FIG. 6 is a graph illustrating an example of change over time in acceleration when a user's walking balance is stable.
Figure 7:
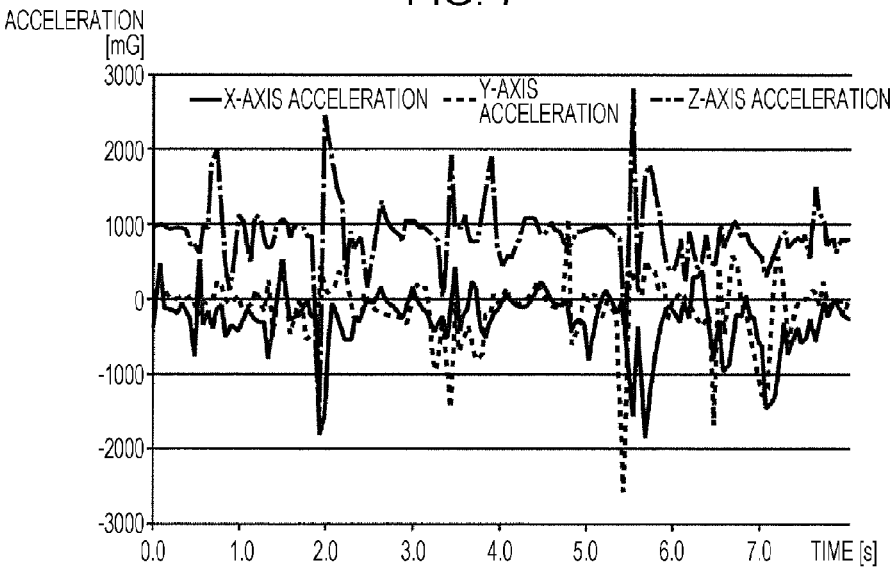
FIG. 7 is a graph illustrating an example of change over time in acceleration when a user's walking balance is unstable.

FIGS. 6 and 7 are graphs illustrating an example of the acceleration of the main part while walking according to Embodiment 1. Specifically, FIG. 6 illustrates an example of change over time in acceleration when the walking balance of the user 10 is stable. Meanwhile, FIG. 7 illustrates an example of change over time in acceleration when the walking balance of the user 10 is unstable. In FIGS. 6 and 7, the horizontal axis represents time, while the vertical axis represents acceleration. As FIGS. 6 and 7 demonstrate, when the walking balance is unstable, the timewise variance in the acceleration along each axis increases. In other words, if the stability of walking balance is reduced, the variance in the acceleration increases.

Next, the balance evaluator 142 determines whether or not the evaluation score is greater than a threshold value (S30). In other words, the balance evaluator 142 determines whether or not the walking balance of the user 10 is unstable. This threshold value is a lower limit value of the variance indicating that the walking balance of the user 10 is unstable, and may be experientially or experimentally determined in advance. A specific example of a method of deciding the threshold value will be discussed later in Embodiment 3.

At this point, if the evaluation score is greater than the threshold value (S30, Yes), the emitting controller 144 adjusts the standard light emitting angle (S40). Specifically, the emitting controller 144 decreases the standard light emitting angle. Consequently, the light emitting position may be brought closer to the user 10. As a result, the user may be guided to thrust the stick next at a position close to the user's body, and the degraded walking balance may be improved.

Figure 8:
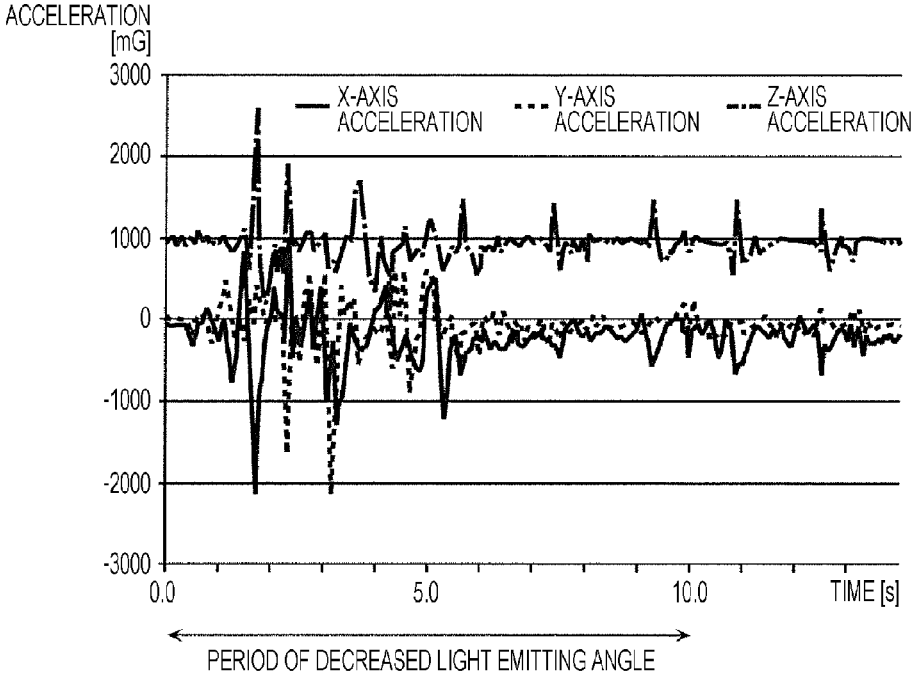
FIG. 8 is a graph illustrating an example of change over time in acceleration when a standard light emitting angle is decreased.

FIG. 8 is a graph illustrating an example of change over time in acceleration when the standard light emitting angle is decreased. In the period of decreased standard light emitting angle (0 s to 10 s), the variance in the acceleration gradually decreases, thus demonstrating that the stability of walking balance is improving.

If the evaluation score is less than or equal to the threshold value (S30, No), the emitting controller 144 does not adjust the standard light emitting angle.

Next, the sensor 130 detects the inclination angle of the stick (S50). In other words, the sensor 130 detects the inclination angle $\beta$ between the lengthwise direction of the main part 110 and the vertical direction. The inclination angle may be detected by using an inclination angle sensor.

The emitting controller 144 uses the detected inclination angle and the standard inclination angle to decide the light emitting angle (S60). Specifically, the emitting controller 144 computes the light emitting angle $\gamma$ according to Math. 1 above.

The emitting controller 144 causes the light emitter 150 to emit light at the decided light emitting angle. Specifically, the emitting controller 144 controls the actuator 156 to rotate the light source 152, and thereby causes the light emitter 150 to emit light at the light emitting angle $\gamma$.

The controller 140 determines whether or not the user is still walking (S80). Specifically, the controller 140 determines whether or not the user is still walking based on the value of the acceleration or the angular velocity of the main part 110 obtained from the sensor 130. For example, if there is no change in the acceleration or the angular velocity within a fixed amount of time, the controller 140 may determine that walking has ended. At this point, in the case of determining that the user is still walking (S80, Yes), the process returns to step S20. On the other hand, in the case of determining that the user is not still walking (S80, No), the process ends.

[Advantageous Effects]

As above, according to the walking stick 100 in accordance with the present embodiment, the light emitting direction of the light from the light emitter 150 may be controlled based on the detected inclination angle. Consequently, when light is emitted on the ground to indicate the next position at which to thrust the walking stick 100, the light emitting position may be stabilized. As a result, the walking stick 100 is capable of stabilizing the indication of the next position at which to thrust the walking stick 100, and is capable of effectively assisting the walking balance of the user 10.

In addition, according to the walking stick 100 in accordance with the present embodiment, the inclination angle of the main part 110 and the standard light emitting angle may be used to control the light emitting direction. Consequently, if the standard light emitting angle is determined appropriately according to characteristics such as the user 10 and the walking stick 100, for example, the light emitting direction of light may be controlled appropriately according to characteristics such as the user 10 and the walking stick 100, and the walking balance of the user 10 may be assisted effectively.

In addition, according to the walking stick 100 in accordance with the present embodiment, the light emitting direction may be controlled based on the result of the evaluation of the walking balance stability while walking. Consequently, when walking balance is lost while walking, the light emitting direction may be controlled effectively to stabilize walking balance, and falling by the user 10 may be minimized.

In addition, according to the walking stick 100 in accordance with the present embodiment, by decreasing the standard light emitting angle if the evaluation score is greater than the threshold value, the light emitting position may be brought closer to the walking user. Consequently, when the stability of walking balance is reduced, the user 10 may be guided to thrust the walking stick at a closer position, thereby improving the walking balance of the user 10, and minimizing falling.

In addition, according to the walking stick 100 in accordance with the present embodiment, light emission may be started if the evaluation score is greater than the threshold value. Consequently, when the stability of walking balance is reduced, the user may be made to notice the reduction in walking balance, and falling by the user 10 may be minimized.

In addition, according to the walking stick 100 in accordance with the present embodiment, the timewise variance of the acceleration or the angular velocity may be used as the evaluation score, and the stability of walking balance may be evaluated easily.

In addition, according to the walking stick 100 in accordance with the present embodiment, the light emitter 150 may be made to emit light when the tip 102 of the main part 110 is contacting the ground, and thus light may be emitted when starting the next operation for thrusting the stick, and the user may be guided appropriately to the next position at which to thrust the stick.

Embodiment 2

Next, Embodiment 2 will be described. In Embodiment 2, one example of a method of deciding the standard light emitting angle stored in the light emitting angle storage 146 in Embodiment 1 will be described in detail. Note that since the configuration of the walking stick according to the present embodiment is substantially the same as the walking stick according to Embodiment 1, illustration and description will be reduced or omitted.

[Operation of Walking Stick]

Figure 9:
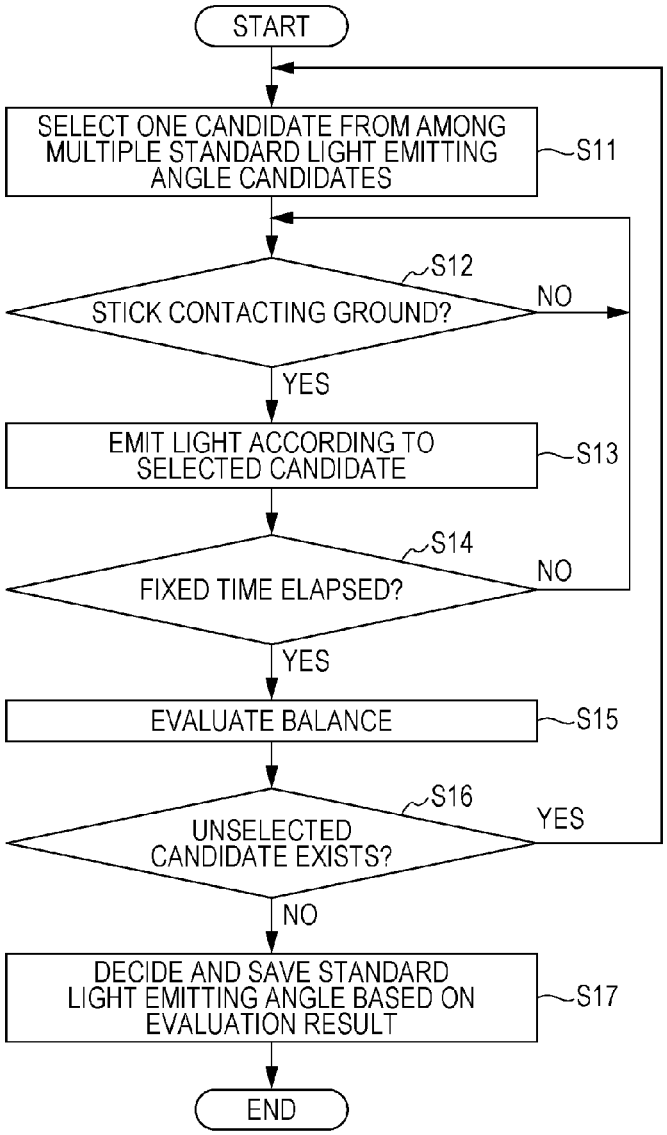
FIG. 9 is a flowchart illustrating a process of deciding a standard light emitting angle of a walking stick according to Embodiment 2.

FIG. 9 is a flowchart illustrating a process of deciding the standard emitting angle of the walking stick according to Embodiment 2. The process in FIG. 9 is conducted before the walking aid process in FIG. 5.

First, the emitting controller 144 selects an unselected candidate from among multiple predetermined standard light emitting angle candidates (S11). The angles used as the multiple standard light emitting angle candidates may be multiple angles (for example, 5 degrees, 10 degrees, 15 degrees, 20 degrees, 25 degrees, and 30 degrees) at a fixed interval (for example, every 5 degrees). These multiple standard light emitting angle candidates may be stored in storage included in the walking assistance device. For example these multiple standard light emitting angle candidates may be stored in a first area of the light emitting angle storage 146.

Next, the ground contact detector 120 detects ground contact of the main part 110 (S12). This ground contact detection is similar to step S10 in Embodiment 1.

At this point, if ground contact of the main part 110 is not detected (S12, No), the process returns to step S12. In other words, step S12 is repeated until ground contact of the main part 110 is detected.

On the other hand, if ground contact of the main part 110 is detected (S12, Yes), the emitting controller 144 causes the light emitter 150 to emit light in accordance with the standard light emitting angle candidate selected in step S11 (S13). Specifically, the emitting controller 144 uses the selected standard light emitting angle candidate to control the light emitting angle of the light according to Math. 1.

The balance evaluator 142 determines whether or not a predetermined, fixed time for evaluating the stability of walking balance has elapsed (S14). Note that instead of a fixed time, the balance evaluator 142 may also determine whether or not the user has walked at least a predetermined, fixed number of steps for evaluating the stability of walking balance. The fixed time may be from a few seconds to approximately 10 seconds, for example. The fixed time may also be dynamically adjusted until the evaluation score of the balance evaluation discussed later stabilizes.

At this point, in the case of determining that the fixed time has not elapsed (S14, No), the process returns to step S12. On the other hand, in the case of determining that the fixed time has elapsed (S14, Yes), the balance evaluator 142 uses sensor values of the user walking acquired from the sensor 130 to evaluate the stability of walking balance (S15). In other words, the balance evaluator 142 computes an evaluation score similarly to step S20 in Embodiment 1. The evaluation score computed at this point is stored in association with the standard light emitting angle candidate selected in step S11.

Next, the controller 140 determines whether or not an unselected candidate exists among the multiple standard light emitting angle candidates (S16). If an unselected standard light emitting angle candidate exists (S16, Yes), the process returns to step S11, and an unselected standard light emitting angle candidate is selected.

If an unselected standard light emitting angle candidate does not exist (S16, No), the balance evaluator 142, based on the evaluation scores which are the evaluation results from step S15, stores one of the multiple standard light emitting angle candidates as the standard light emitting angle in the light emitting angle storage 146. Specifically, the balance evaluator 142 stores the standard light emitting angle candidate corresponding to the evaluation score with the highest walking balance stability from among the multiple standard light emitting angle candidates as the standard light emitting angle in the light emitting angle storage 146. For example, FIGS. 6 and 7 illustrate sensor values when 10 degrees and 30 degrees are selected as the standard light emitting angle, respectively. In FIG. 6, the timewise variance of the acceleration is 261.1, whereas in FIG. 7, the timewise variance of the acceleration is 183678.1. Consequently, FIGS. 6 and 7 demonstrate that the walking balance when the standard light emitting angle candidate is 10 degrees, as in FIG. 6, is more stable than the walking balance when the standard light emitting angle candidate is 30 degrees, as in FIG. 7. In this case, 10 degrees, which has a higher walking balance stability out of the standard light emitting angle candidate of 10 degrees and the standard light emitting angle candidate of 30 degrees, is stored as the standard light emitting angle in the light emitting angle storage 146. The standard light emitting angle decided in this way may be stored in a second area of the light emitting angle storage 146.

[Advantageous Effects]

As above, according to the walking stick in accordance with the present embodiment, one of multiple standard light emitting angle candidates may be stored as the standard light emitting angle in storage, based on the result of the evaluation of walking balance stability when walking using the walking stick 100. Consequently, a standard light emitting angle suited to the characteristics of the walking stick and the user may be determined in advance. By using a standard light emitting angle determined in this way to control the light emitting direction, control of the light emitting direction that is suited to the characteristics of the user and the walking stick becomes possible, and more effective assistance of the user's walking balance becomes possible.

Embodiment 3

Next, Embodiment 3 will be described. In the present embodiment, a fall by the user is detected, the evaluation score of walking balance stability from when the fall was detected is stored, and this evaluation score is used as the threshold value of the balance evaluation (S30 in FIG. 5).

Since the configuration of the walking stick according to the present embodiment is substantially the same as the walking stick according to Embodiment 1, illustration and description will be reduced or omitted.

[Operation of Walking Stick]

Figure 10:
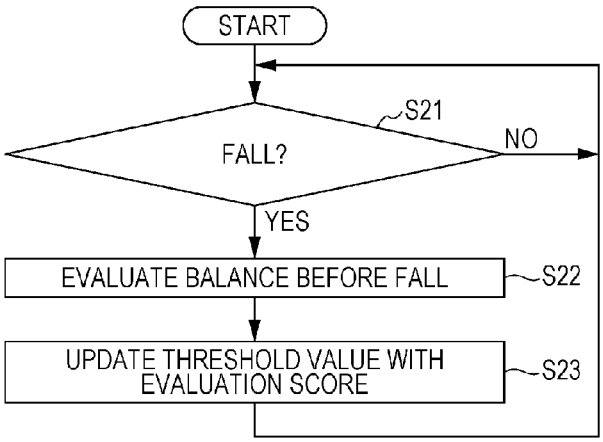
FIG. 10 is a flowchart illustrating a process of updating a threshold value for balance evaluation according to Embodiment 3.

FIG. 10 is a flowchart illustrating a process of updating a threshold value for balance evaluation according to Embodiment 3.

First, the balance evaluator 142 detects a fall by the user 10 (S21). Specifically, the balance evaluator 142 detects a fall based on the acceleration or the angular velocity obtained from the sensor 130, for example. Since the main part 110 turns over suddenly during a fall, the sensor values vary more greatly than when thrusting the stick.

Figure 11:
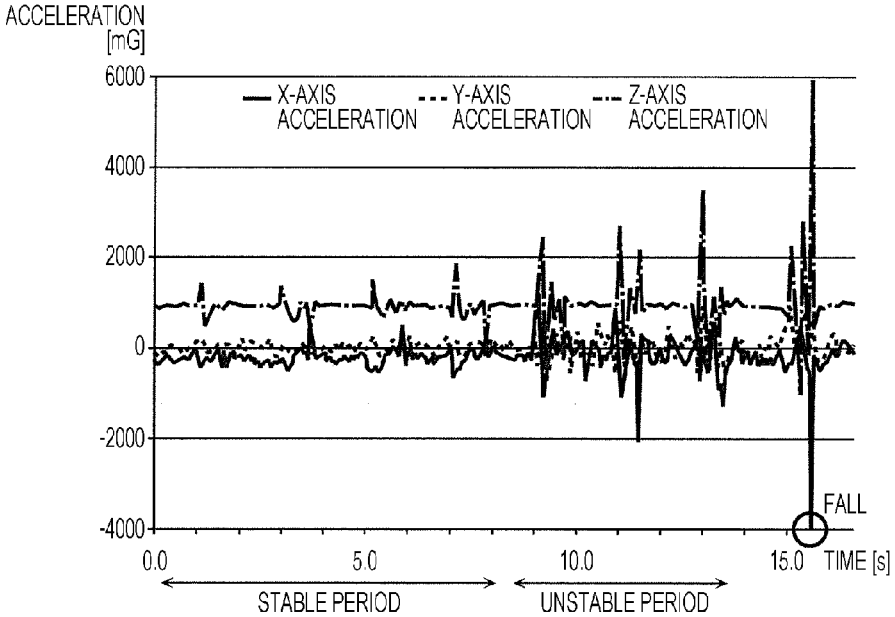
FIG. 11 is a graph illustrating an example of change over time in acceleration when falling.

FIG. 11 illustrates change over time in the sensor values from the acceleration sensor during a fall. As illustrated in FIG. 11, during a fall, the value of the acceleration fluctuates greatly. The balance evaluator 142 uses these sensor values to detect a fall with a technique such as a typical threshold value process. For example, in FIG. 11, the balance evaluator 142 is able to detect a fall by using an acceleration of +4000 mG along the Z-axis (the lengthwise direction of the main part 110) as the threshold value.

At this point, if a fall is not detected (S21, No), the process returns to step S21. In other words, the fall detection is repeated. If a fall is detected (S21, Yes), the balance evaluator 142 computes the evaluation score of the walking balance during a certain period immediately before the fall was detected, and stores the computed evaluation score as the threshold value of the balance evaluation in the light emitting angle storage 146 (S23). In other words, the balance evaluator 142 updates the threshold value of the balance evaluation with the evaluation score from immediately before the fall. For example, in FIG. 11, the variance "184456.6" of the acceleration in the unstable period lasting approximately five seconds immediately before the fall is stored as the threshold value of the balance evaluation in the light emitting angle storage 146. The evaluation score stored at this point is used as the threshold value in step S30 of FIG. 5.

[Advantageous Effects]

As above, according to the walking stick in accordance with the present embodiment, the evaluation score of the walking balance stability during a certain period immediately prior to a fall being detected may be used as the certain threshold value. Consequently, the evaluation score of walking balance stability when the user actually falls may be used to control the light emitting direction, and falls by the user may be minimized further.

By saving this value (184456.6) of the variance over a certain time before the fall, the user may be informed whether the current walking is poses a risk of falling. When the user walks, the saved balance evaluation score and the current balance evaluation score are compared, and if the current balance evaluation score is worse than the balance evaluation score from the time of a fall, it is judged that the user's walking poses a risk of falling, the light emitting angle is reduced, and the user is encouraged to reduce the walking speed. According to the above sequence, by controlling the specified angle so that the balance when walking does not become worse than the balance evaluation score from when the user actually fell, it becomes possible to preemptively avoid falls by the user.

Embodiment 4

Next, Embodiment 4 will be described. The present embodiment differs from the previous embodiments in that light emission is started when the stability of walking balance is reduced. Note that since the configuration of the walking stick according to the present embodiment is substantially the same as the walking stick according to Embodiment 1, illustration and description will be reduced or omitted.

[Operation of Walking Stick]

Figure 12:
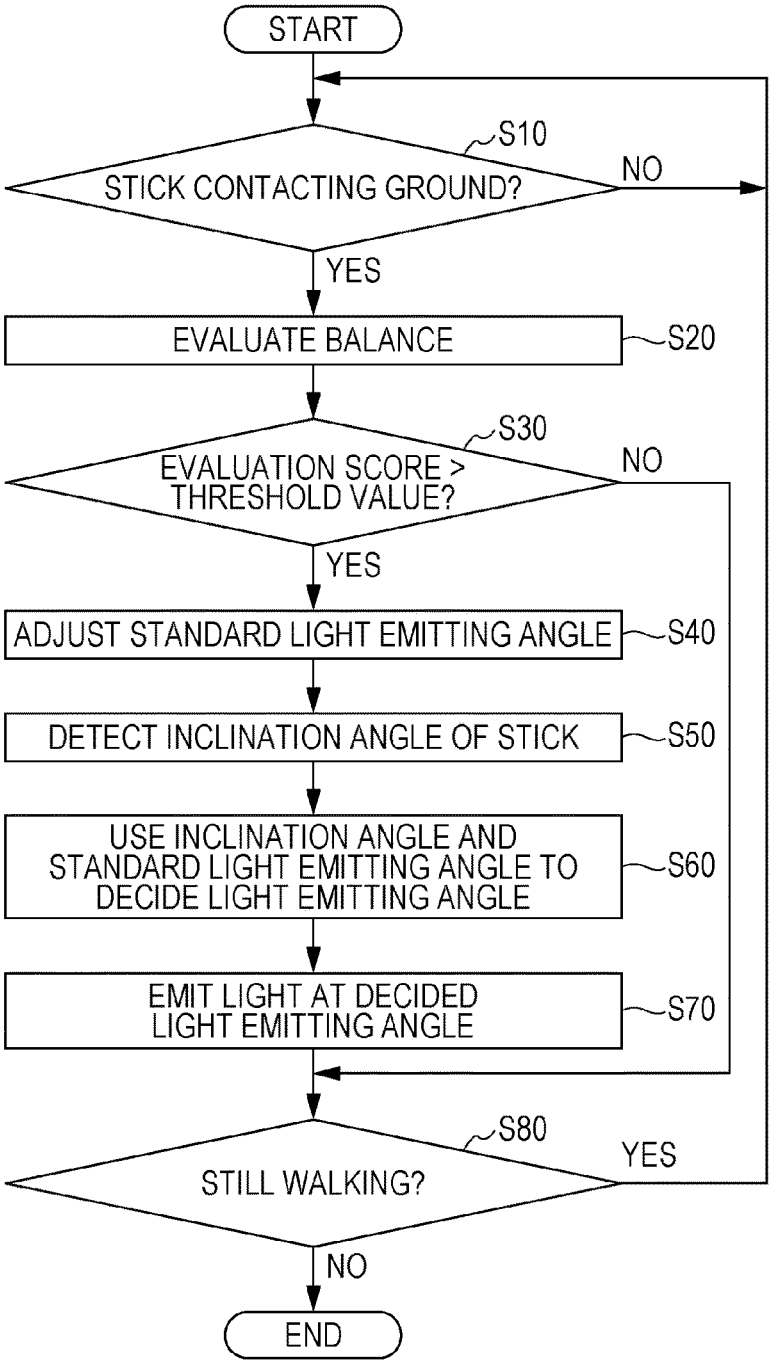
FIG. 12 is a flowchart illustrating a walking aid process of a walking stick according to Embodiment 4.

FIG. 12 is a flowchart illustrating a walking aid process of a walking stick according to Embodiment 4. In FIG. 12, processes that are substantially the same as FIG. 5 are denoted with the same signs, and the description thereof is reduced or omitted as appropriate.

In the present embodiment, if the evaluation score is less than or equal to the threshold value (S30, No), the processing from step S50 to step S70 is skipped, and step S80 is executed. Conversely, if the evaluation score is greater than the threshold value (S30, Yes), the processing from step S50 to step S70 is executed. In other words, if the evaluation score is greater than the threshold value (S30, Yes), the emitting controller 144 causes the light emitter 150 to start emitting light (S70).

[Advantageous Effects]

According to the walking stick 100 in accordance with the present embodiment, light emission may be started if the evaluation score is greater than the threshold value. Consequently, since light emission is not started when the walking balance is stable, the user 10 is able to walk without paying attention to the light emitting position, and walk freely without being limited by the light emission. On the other hand, since light emission may be started if the stability of walking balance is reduced, the light may be used to explicitly inform the user that walking balance is reduced, and the user may be encouraged to improve walking balance.

Embodiment 5

Next, Embodiment 5 will be described. In the present embodiment, a standard light emitting angle corresponding to an estimated walking condition is used to control the light emitting direction. Note that since the configuration of the walking stick according to the present embodiment is substantially the same as the walking stick according to Embodiment 1, illustration and description will be reduced or omitted as appropriate.

In the present embodiment, the light emitting angle storage 146 stores multiple standard light emitting angles corresponding to multiple walking conditions. A walking condition expresses a condition of the surroundings that affects the user's walking balance. Specifically, walking conditions include conditions such as level ground, ascending stairs, descending stairs, going uphill, and going downhill. In the present embodiment, level ground, ascending stairs, and descending stairs are used as the walking conditions. Note that for the walking conditions, typical conditions may be predefined, or conditions may be successively and adaptively added when a walking condition occurs which is not classifiable into a predefined walking condition.

FIG. 13 is a diagram illustrating an example of multiple standard light emitting angles stored in the light emitting angle storage according to Embodiment 5. In FIG. 13, "30 degrees", "20 degrees", and "15 degrees" are stored as standard light emitting angles corresponding to "level ground", "ascending stairs", and "descending stairs", respectively.

The balance evaluator 142 uses the acceleration or the angular velocity detected by the sensor 130 to estimate the walking condition of the user 10. Details of this estimation of the walking condition will be discussed later using FIGS. 14 to 16.

The emitting controller 144 acquires, from the light emitting angle storage 146, the standard light emitting angle corresponding to the walking condition estimated by the balance evaluator 142. Subsequently, the emitting controller 144 uses the acquired standard light emitting angle to control the light emitting direction of the light emitter 150.

[Operation of Walking Stick]

Figure 14:
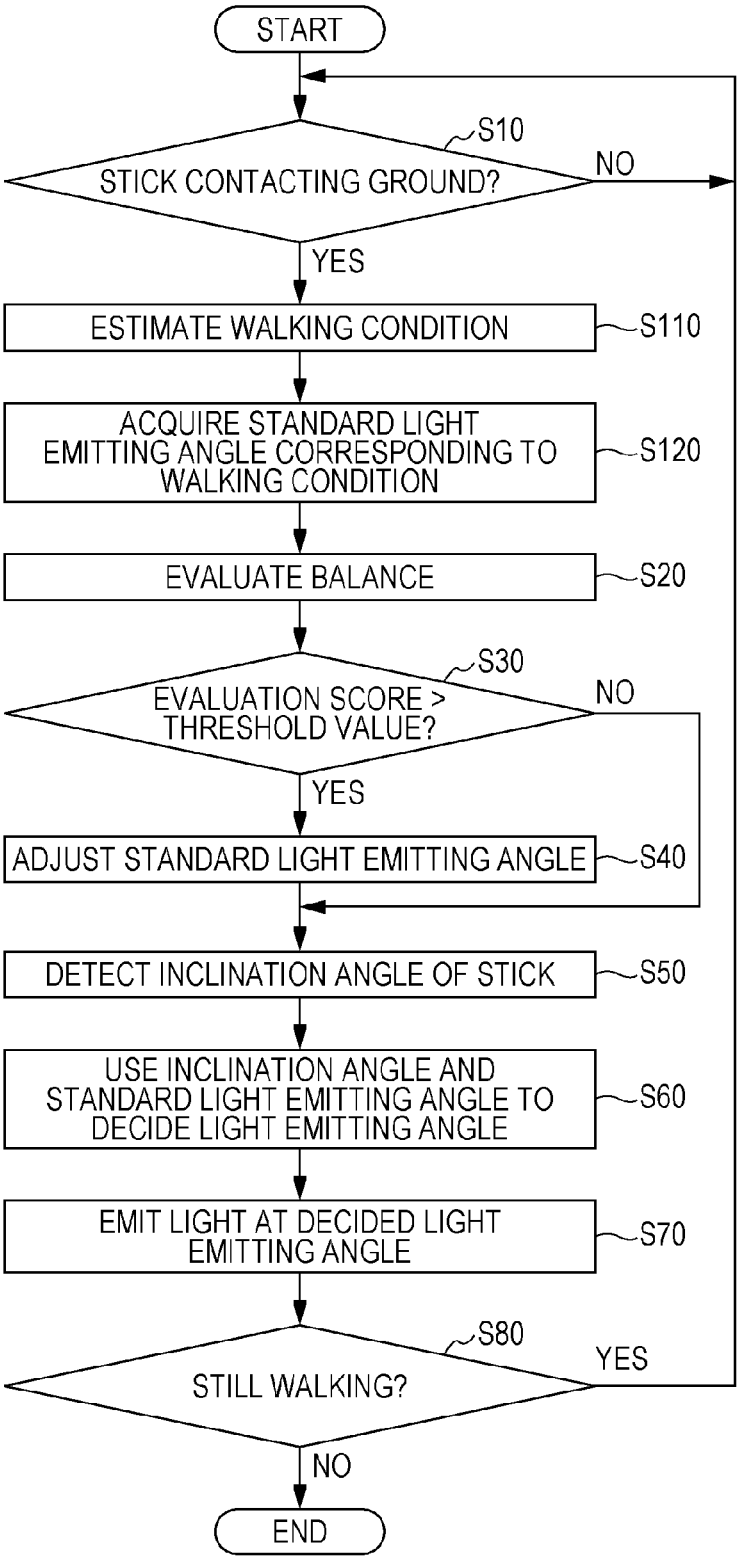
FIG. 14 is a flowchart illustrating a walking aid process of a walking stick according to Embodiment 5.

FIG. 14 is a flowchart illustrating a walking aid process of a walking stick according to Embodiment 5. In the present embodiment, when ground contact of the main part 110 is detected (S10, Yes), the balance evaluator 142 estimates the walking condition of the user 10 currently walking with the walking stick 100 (S110). Specifically, the balance evaluator 142 uses the acceleration or the angular velocity detected by the sensor 130 to estimate the walking condition of the user 10.

Figure 15:
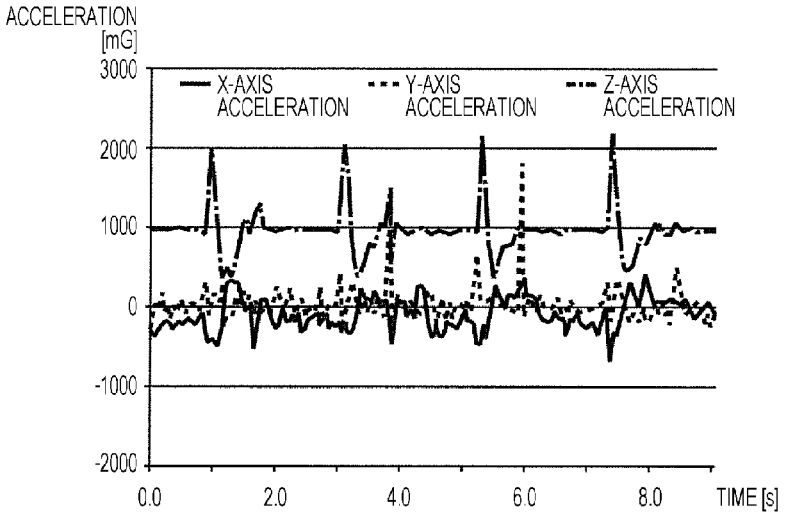
FIG. 15 is a graph illustrating an example of change over time in acceleration when ascending stairs with a walking stick.
Figure 16:
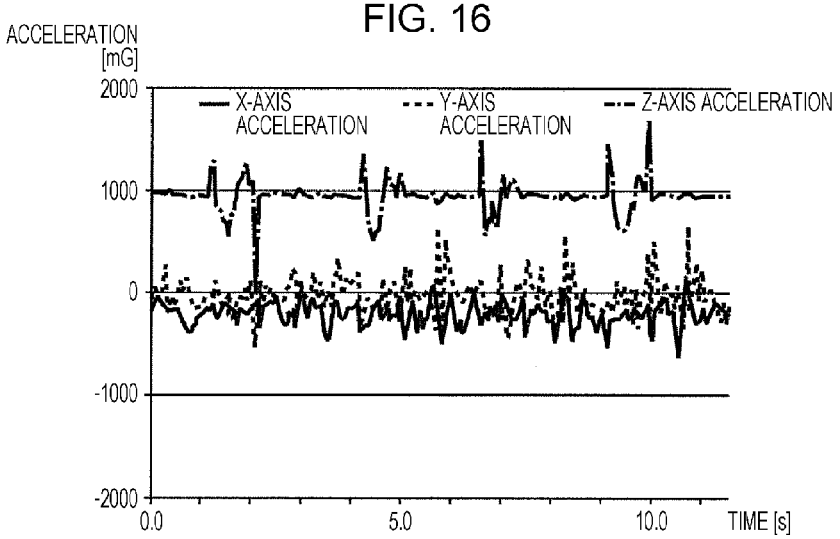
FIG. 16 is a graph illustrating an example of change over time in acceleration when descending stairs with a walking stick.

FIG. 15 illustrates an example of change over time in acceleration when ascending stairs with a walking stick. FIG. 16 illustrates an example of change over time in acceleration when descending stairs with a walking stick. Compared to the change over time in acceleration when walking on level ground as in FIG. 6, the variation of the acceleration in the Z-axis direction is greater in FIG. 15, while conversely, the variation of the acceleration in the Z-axis direction is less in FIG. 16. In this way, the characteristics of the acceleration are different depending on the walking condition.

Accordingly, features may be computed from the acceleration, and typical machine learning techniques such as a decision tree, logistic regression, and a support vector machine (SVM) may be used to estimate the walking condition from the computed features. The estimation of the walking condition may be realized with machine learning techniques like those indicated in, for example, Ling Bao and Stephen S. Intille, "Activity recognition from user annotated acceleration data.", Pervasive Computing, pp. 1-17, 2004.

Next, the emitting controller 144 acquires, from the light emitting angle storage 146, the standard light emitting angle corresponding to the estimated walking condition (S120). For example, if the walking condition is estimated to be level ground, the emitting controller 144 references FIG. 13 and acquires 30 degrees as the standard light emitting angle.

After that, the processing from step S20 to step S80 is executed similarly to FIG. 5 of Embodiment 1, using the standard light emitting angle acquired in step S120.

[Advantageous Effects]

As above, according to the walking stick 100 in accordance with the present embodiment, the standard light emitting angle corresponding to the estimated walking condition may be used to control the light emitting direction. Consequently, a standard light emitting angle that is suited to situations such as walking on level ground or walking up or down stairs, for example, may be used to control the light emitting direction, and the walking balance of the user 10 may be assisted more effectively.

Other Embodiments

The foregoing thus describes a walking stick and a walking assistance device according to one or more aspects on the basis of the embodiments, but the present disclosure is not limited to these embodiments. Embodiments obtained by applying various modifications that may occur to persons skilled in the art as well as embodiments constructed by combining the structural elements in different embodiments may also be included within the scope of the one or more exemplary embodiments insofar as such embodiments do not depart from the spirit of the present disclosure.

For example, all of the above Embodiments 1 to 5 may be combined.

Note that in the foregoing embodiments, the variance is used as the indicator of walking balance stability, but the indicator is not limited thereto. For example, as indicated in Yamada, Hirata, Ono, and Ando, "The Assessment of an Abnormal Gait by Gait Parameters derived from Trunk Acceleration in Patients with Osteoarthritis of the Hip", The Journal of Japanese Physical Therapy Association 33(1), pp. 14-21, 2006, a power spectrum analysis, a root mean square (RMS), an autocorrelation coefficient, and a cross-correlation coefficient may also be used as indicators of walking balance stability. In Yamada et al., these parameters are used as indicators expressing the smoothness of gait, lurching, symmetry/regularity, and similarity to a normal walking waveform, respectively.

Note that in the foregoing embodiments, the walking assistance device 112 is equipped with the ground contact detector 120, but the ground contact detector 120 is not strictly required. It is sufficient for the walking assistance device 112 to be equipped with at least the sensor 130, the controller 140, and the light emitter 150. Even in this case, the light emitting direction of the light emitter 150 may be controlled based on the detected inclination angle, and the user's walking balance may be assisted effectively.

Note that in the foregoing embodiments, the ground contact detector 120 detects ground contact of the main part 110 by using a pressure sensor, but the configuration is not limited thereto. For example, an acceleration sensor may also be used to detect ground contact of the walking stick 100. Since an impact is imparted to the stick when the thrusting the stick against the ground, the acceleration varies greatly, as illustrated in FIG. 6. Consequently, by detecting this impact with an acceleration sensor, ground contact of the main part 110 may be detected.

Note that although the foregoing embodiments primarily describe the case in which the sensor 130 is provided with an acceleration sensor, the light emitting direction may be controlled similarly even with an angular velocity sensor.

Figure 17:
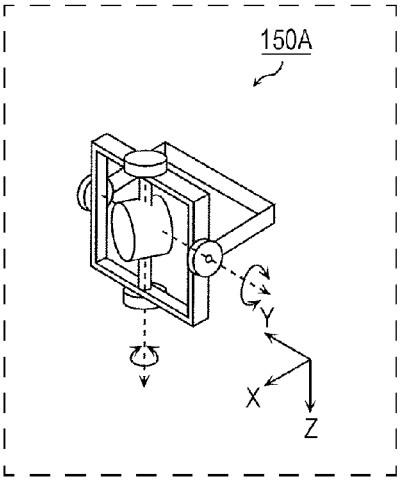
FIG. 17 is a diagram illustrating an example of a mechanism of a light emitter according to another embodiment.

Note that the structure of the light emitter 150 illustrated in FIG. 2 is an example, and not limited thereto. For example, in FIG. 2, the light emitter 150 is rotatable about one axis, but may also include a mechanism enabling rotation about two axes. In this case, the light emitter 150A may include a gimbal mechanism as illustrated in FIG. 17, for example.

Figure 18:
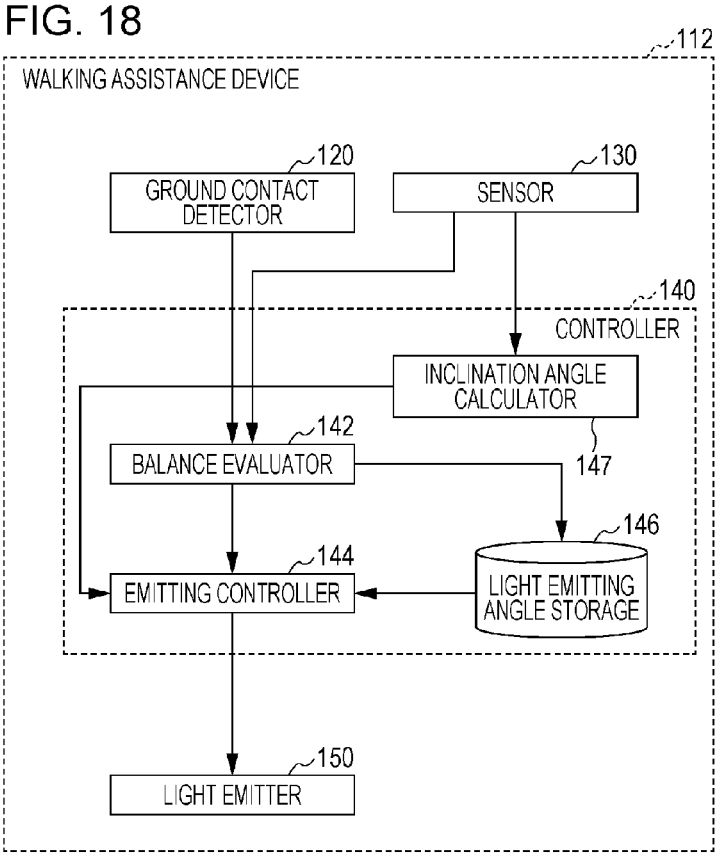
FIG. 18 is a diagram illustrating a functional configuration of a walking stick according to another embodiment.

Note that in the foregoing embodiments, the sensor includes an inclination angle sensor that detects the inclination angle of the main part 110, but the sensor is not limited thereto. For example, the sensor may also not include an inclination angle sensor. In this case, the controller 140 of the walking assistance device 112 may be equipped with an inclination angle calculator 147 that calculates the inclination angle of the main part 110 by using output values from at least one of an angular velocity sensor and an acceleration sensor, as illustrated in FIG. 18. Provided that g represents gravitational acceleration, $\beta$ the inclination angle, and z the output value in the Z-axis direction from the acceleration sensor, the inclination angle calculator 147 may calculate the inclination angle $\beta$ according to $\cos \beta = z/g$. As another example, the inclination angle calculator 147 may also calculate the inclination angle by using the integral of output values from the angular velocity sensor. Note that the inclination angle calculated by the inclination angle calculator may be called the detected inclination angle in some cases.

Note that the controller 140 according to the foregoing embodiments may be configured by a single electronic circuit or by multiple electronic circuits. In addition, the walking assistance device 112 may be equipped with a processor and non-transitory memory, in which the processor functions as the controller 140 when the processor executes a software program or instructions stored in the memory.

The present disclosure may be used as a walking stick able to assist a user's walking, and a walking assistance device attached to the walking stick.

What is claimed is:

1. A walking stick comprising:

a main part that is stick-like;

a sensor that detects at least one of an acceleration of the main part and an angular velocity of the main part;

a light emitter that emits light on a ground;

a ground contact sensor that detects contact, at a tip of the main part, with the ground; and a controller that includes a balance evaluator and an emitting controller, wherein when the ground contact sensor detects that the tip contacts the ground, the balance evaluator evaluates a walking balance stability of a user based on at least one of the detected acceleration and the detected angular velocity, and the emitting controller controls a light emitting direction of the light based on a result of the evaluated walking balance stability and an inclination angle of the main part.

2. The walking stick according to claim 1, wherein the emitting controller continues to emit light from the light emitter at a certain light emitting position on the ground for a certain amount of time, even if the inclination angle of the main part changes.

3. The walking stick according to claim 2, wherein the certain amount of time is a time from when the ground contact sensor detects contact of the tip until the ground contact sensor detects the next contact.

4. The walking stick according to claim 1, wherein the emitting controller controls the light emitting direction using the inclination angle of the main part and a standard light emitting angle indicating a predetermined light emitting direction with respect to a predetermined inclination angle, and adjusts the standard light emitting angle based on the result of the evaluated walking balance stability.

5. The walking stick according to claim 4, wherein provided that $\alpha$ represents the standard light emitting angle when the standard inclination angle is 0 degrees with respect to a vertical direction, and $\beta$ represents the inclination angle between a lengthwise direction of the main part of the stick and the vertical direction, the emitting controller uses $\alpha$ and $\beta$ to compute a light emitting angle $\gamma$ between the lengthwise direction of the main part of the stick and the optical axis of light from the light emitter according to $$\gamma = \cos^{-1}\frac{1 - \tan\alpha\sin\beta}{\sqrt{1 + \tan^2\alpha - 2\tan\alpha\sin\beta}}$$

and uses the computed light emitting angle $\gamma$ to control the light emitting direction.

6. The walking stick according to claim 4, wherein the emitting controller decreases the standard light emitting angle if an evaluation score that expresses a value of walking balance stability, obtained as a result of the evaluated walking balance stability, is greater than a certain threshold value.

7. The walking stick according to claim 6, wherein the emitting controller causes the light emitter to start emitting light if the evaluation score is greater than the certain threshold value.

8. The walking stick according to claim 6, wherein the evaluation score is at least one of a timewise variance of the detected acceleration and a timewise variance of the detected angular velocity.

9. The walking stick according to claim 6, wherein the balance evaluator additionally detects a fall by the user, and computes an evaluation score of the walking balance stability during a certain period immediately prior to the fall being detected, and the computed evaluation score is used as the certain threshold value.

10. The walking stick according to claim 4, wherein the controller additionally includes storage for storing a plurality of standard light emitting angle candidates, the balance evaluator evaluates walking balance stability when light is emitted in accordance with the predetermined plurality of standard light emitting angle candidates, and based on the result of the evaluated walking balance stability when light is emitted, stores one of the multiple standard light emitting angle candidates as the standard light emitting angle in the storage, and the emitting controller acquires the standard light emitting angle from the storage, and uses the acquired standard light emitting angle to control the light emitting direction.

11. The walking stick according to claim 10, wherein the storage stores a plurality of standard light emitting angles corresponding to a plurality of walking conditions, the balance evaluator uses, when the walking balance stability when light is emitted is evaluated, at least one of the detected acceleration and the detected angular velocity to estimate a walking condition of the user currently walking with the walking stick, and the emitting controller acquires, from the storage, the standard light emitting angle corresponding to the estimated walking condition, and uses the acquired standard light emitting angle to control the light emitting direction.

12. The walking stick according to claim 1, wherein the emitting controller causes the light emitter to emit light when the tip of the main part is contacting the ground.

13. The walking stick according to claim 1, wherein the sensor additionally detects the inclination angle of the main part.

14. The walking stick according to claim 1, wherein the controller additionally includes an inclination angle calculator that calculates the inclination angle of the main part, based on at least one of the acceleration and the angular velocity detected by the sensor.

15. A walking assistance device attached to a walking stick, the walking assistance device comprising:

a sensor that detects at least one of an acceleration of the walking stick and an angular velocity of the walking stick;

a light emitter that emits light on a ground;

a ground contact sensor that detects contact, at a tip of a main part of the walking stick, with the ground;

a balance evaluator that evaluates a walking balance stability of a user based on at least one of the detected acceleration and the detected angular velocity; and an emitting controller that controls a light emitting angle of the light from the light emitter based on a result of the evaluated walking balance stability and an inclination angle of the walking stick, wherein when the ground contact sensor detects that the tip contacts the ground, the balance evaluator evaluates the walking balance stability of the user based on the at least one of the detected acceleration and the detected angular velocity and the emitting controller controls the light emitting direction of the light based on the result of the evaluated walking balance stability and the inclination angle of the walking stick.

16. A walking stick comprising:

a main part that is stick-like;

a sensor that detects at least one of a first acceleration of the main part and a first angular velocity of the main part during a first period and at least one of a second acceleration of the main part and a second angular velocity of the main part during a second period immediately after the first period;

a light emitter that emits light on a ground; and a controller that includes a balance evaluator and an emitting controller, wherein the balance evaluator makes a first evaluation of a first walking balance stability of a user based on at least one of the first detected acceleration and the first detected angular velocity, wherein the emitting controller controls a first light emitting direction of the light for the second period based on the first evaluation and an inclination angle of the main part during the first period, wherein the balance evaluator makes a second evaluation of a second walking balance stability of the user based on at least one of the second detected acceleration and the second detected angular velocity, wherein the emitting controller controls a second light emitting direction of the light for a third period immediately after the second period based on the second evaluation and an inclination angle of the main part during the second period, and wherein the first period, the second period, and the third period are included in one consecutive walking of the user.

17. A walking stick comprising:

a main part that is stick-like;

a sensor that detects at least one of an acceleration of the main part and an angular velocity of the main part;

a light emitter that emits light on a ground; and a controller that includes a balance evaluator and an emitting controller, the balance evaluator evaluates a walking balance stability of a user based on at least one of the detected acceleration and the detected angular velocity, and the emitting controller controls a light emitting direction of the light based on a result of the evaluated walking balance stability and an inclination angle of the main part, wherein the emitting controller controls the light emitting direction using the inclination angle of the main part and a standard light emitting angle indicating a predetermined light emitting direction with respect to a predetermined inclination angle, and adjusts the standard light emitting angle based on the result of the evaluated walking balance stability, and provided that $\alpha$ represents the standard light emitting angle when the standard inclination angle is 0 degrees with respect to a vertical direction, and $\beta$ represents the inclination angle between a lengthwise direction of the main part of the stick and the vertical direction, the emitting controller uses $\alpha$ and $\beta$ to compute a light emitting angle $\gamma$ between the lengthwise direction of the main part of the stick and the optical axis of light from the light emitter according to $$\gamma = \cos^{-1}\frac{1 - \tan\alpha\sin\beta}{\sqrt{1 + \tan^2\alpha - 2\tan\alpha\sin\beta}}$$

and uses the computed light emitting angle $\gamma$ to control the light emitting direction.

* * * * *